US005828294A

United States Patent [19]

Shank

[11] Patent Number: 5,828,294

[45] Date of Patent: Oct. 27, 1998

[54] CUSTOMER ACTIVATED SIGNAL FOR SERVICE

[76] Inventor: Edward J. Shank, 6401 Randy Dr., Charlotte, N.C. 28215

[21] Appl. No.: 780,809

[22] Filed: Jan. 9, 1997

Related U.S. Application Data

[63] Continuation-in-part of Ser. No. 194,474, Jan. 31, 1994, Pat. No. 5,594,409.

[51] Int. Cl.[6] ..... G08B 5/00

[52] U.S. Cl. ..... 340/326; 340/286.06; 340/286.09; 340/332

[58] Field of Search ..... 340/326, 332, 340/286.06, 286.09

[56] References Cited

U.S. PATENT DOCUMENTS

| | | | |
|---|---|---|---|
| 1,796,668 | 3/1931 | Sarfety | 390/286.09 |
| 3,810,164 | 5/1974 | Lambert | 390/332 |
| 4,701,849 | 10/1987 | Elden | 364/401 |
| 4,777,488 | 10/1988 | Carlmen, Jr. et al. | 340/825.72 |
| 5,355,115 | 10/1994 | Goor et al. | 340/321 |
| 5,594,409 | 1/1997 | Shank | 340/326 |

FOREIGN PATENT DOCUMENTS

| | | | |
|---|---|---|---|
| 1321598 | 12/1989 | Japan | 340/286.09 |

*Primary Examiner*—Edward Lefkowitz
*Attorney, Agent, or Firm*—Clifton Ted Hunt

[57] ABSTRACT

This invention relates to signaling systems of the type used by customers in a service facility, such as taverns, restaurants and stores, to alert service personnel that a specific customer desires service. One embodiment is limited to one or more local indicators used by customers to transmit signals for service to service personnel in the vicinity of the local indicators. Another embodiment uses local indicators and remote indicators. The local indicators have transmitters that transmit customers' signals for service to the remote indicators, that are equipped to alert service personnel anywhere on the premises that one or more specific customers desire service.

5 Claims, 3 Drawing Sheets

CUSTOMER ACTIVATED SIGNAL FOR SERVICE

CROSS REFERENCE OF RELATED APPLICATIONS

This application is a continuation-in-part of my application Ser. No. 08/194,474, filed Jan. 31, 1994, now U.S. Pat No. 5,594,709 for CUSTOMER ACTIVATED DEVICE.

FIELD OF THE INVENTION

This invention relates to signaling systems of the type used by customers in a service facility, such as taverns, restaurants and stores, to alert service personnel that a specific customer desires service.

BACKGROUND OF THE INVENTION

It is customary for service personnel, such as waiters in taverns and clerks in stores, to be anywhere within the premises and yet be responsible for responding to requests for service by specific customers. It is sometimes difficult for a customer desiring service to get the attention of service personnel.

The prior art has recognized this problem and presented several proposed solutions. See, for example, U.S. Pat. No. 3,810,164 issued May 7, 1974 to Adelor A. Lambert for COMBINATION SIGNALING AND ADVERTISING SYSTEM.

SUMMARY OF THE INVENTION

One embodiment of the invention comprises a customer activated local indicator including a signal light, a bistable circuit and a source of electric power, such as a battery, housed in any suitable enclosure that is available to customers. The enclosure may be a simulated product that serves a dual function of (1) advertising the establishment's merchandise, such as a simulated beer bottle in a tavern, and (2) serving as a housing for the signal light, the bistable circuit, and the battery.

Optionally, a remote indicator may be provided to alert service personnel located at a distance from the customer desiring service, and the local indicator may include a transmitter to transmit a customer's signal for service to the remote indicator.

DETAILED DESCRIPTION OF THE INVENTION

The Local Indicator

Figure 1:
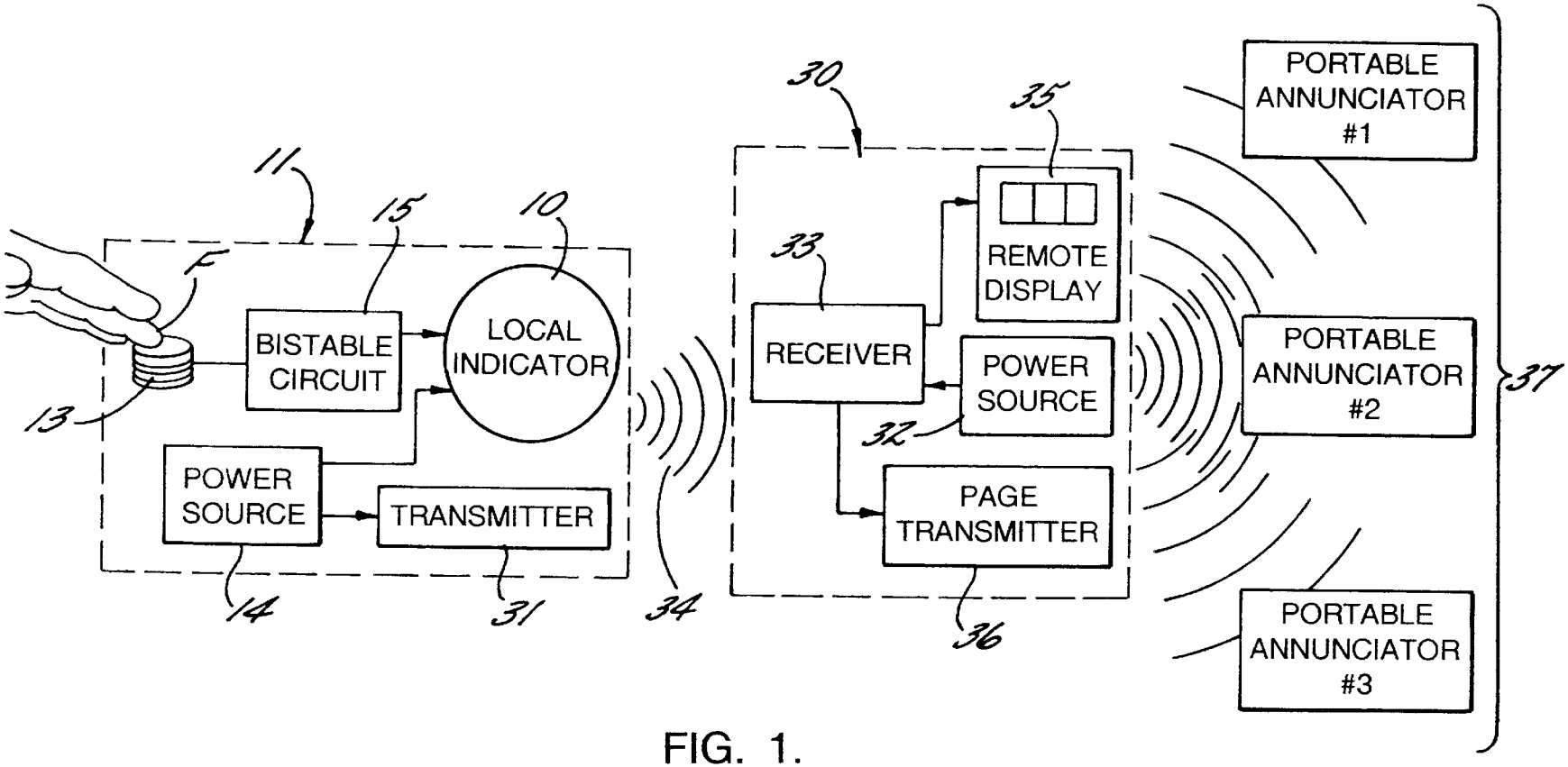
FIG. 1 is a block diagram illustrating components of a local indicator in one embodiment of the invention.

Referring more specifically to the drawings, one embodiment of the customer activated signal is a local indicator 10 comprising an enclosure 11 that houses a signal light 12, a proximity sensor 13, a battery 14, and a bistable circuit 15 operably connecting the signal light 12 with the proximity sensor 13 and the battery 14. The local indicator is preferably portable, but can be stationary, if desired.

A battery, either replaceable or rechargeable, is the preferred source of power but the invention can be used with an external power source, if desired.

Figure 2:
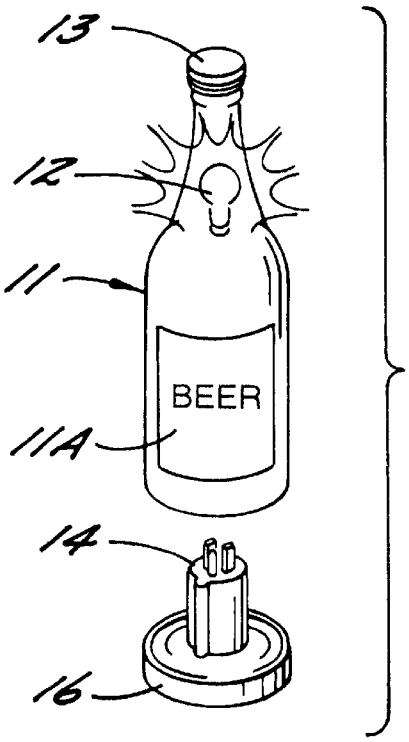
FIG. 2 is an exploded perspective view of a local indicator, wherein the enclosure is a simulated beer bottle that houses the signal light, the bistable circuit, and the battery.

The enclosure 11 may be of any desired form, ranging from a simple box to a simulated beer bottle 11 and its advertising label 11A (FIG. 2).

The proximity sensor 13 is responsive to objects coming within any predetermined range of the sensor 13, preferably being responsive to the touch of a customer's FIG. 22 (FIG. 1).

In the illustrated embodiment, the cap of the simulated beer bottle 11 functions as the proximity sensor 13, and the bistable circuit 15 and the signal light 12 are inside the bottle or enclosure 11. The battery 14 is in the lower portion 16 of the bottle 11 (FIG. 2), and is operably connected to the bistable circuit 15 within the bottle.

Figure 5:
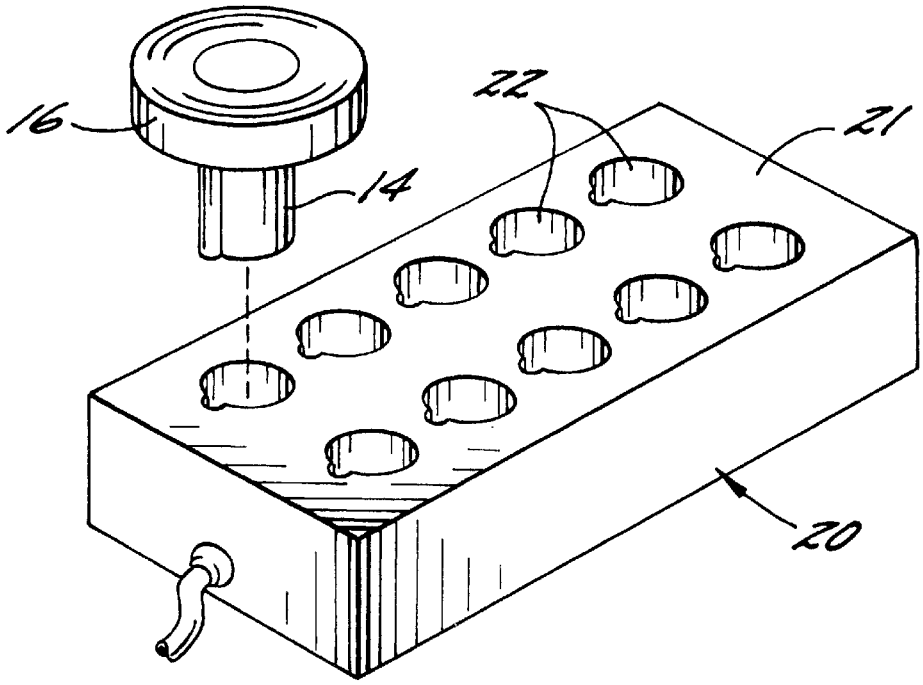
FIG. 5 is an exploded perspective view illustrating the charging of a battery removed from a local indicator.

The battery 14 is preferably a rechargeable battery. A suitable battery charger is illustrated at 20 in FIG. 5. The battery charger 20 includes a substantially flat top surface 21 having a plurality of identical sockets 22 therein. Recharging a battery 14 requires that it be uncoupled from the circuitry 15 and removed from its enclosure 11. The battery to be recharged is then inverted to the position shown in FIG. 5 and inserted into a socket 22 in the battery charger 20. The charger 20 then provides a charging current to the battery.

Figure 3:
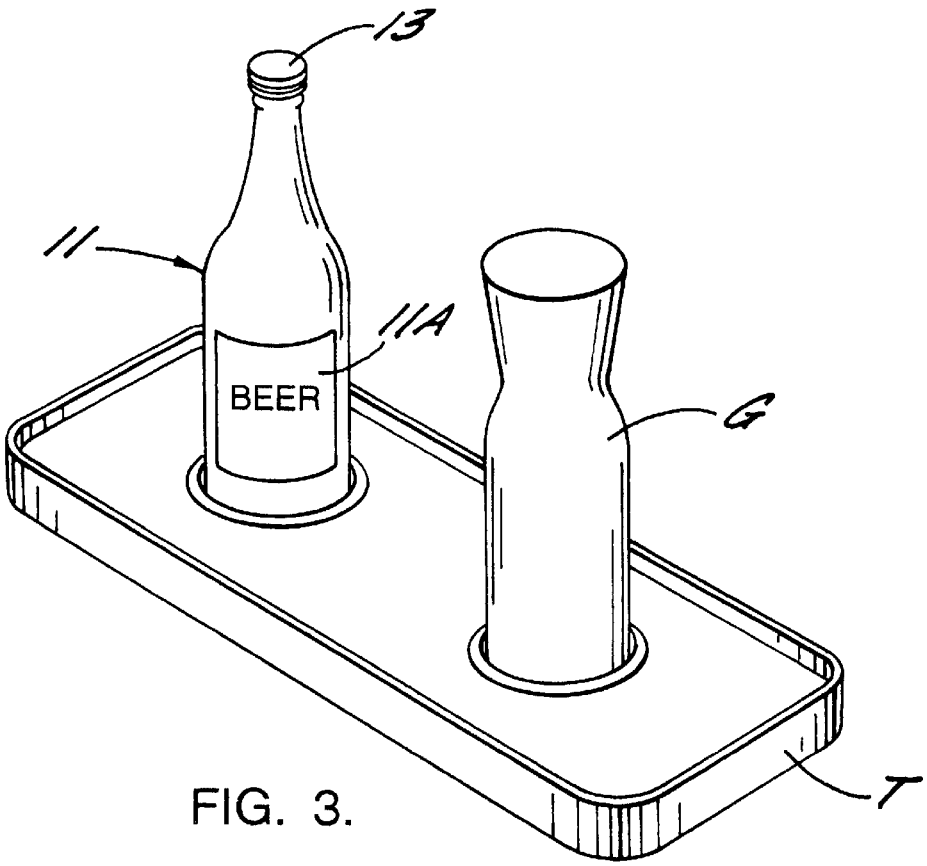
FIG. 3 is a perspective view of the simulated beer bottle shown in FIG. 2 in conjunction with a gratuity collection jar.

Local indicators 10 may be spaced along a bar and combined with a gratuity jar G on trays T (FIG. 3), or placed on individual tables in a small tavern or other location where the service personnel are customarily present and can see the signal light glowing in an indicator after its proximity sensor has been touched to signal for service.

A remote indicator is desirable for larger establishments where the service personnel are sometimes located at a distance from the customers and cannot see the signals for service emitted by activated local indicators.

The Remote Indicator

Use of remote indicators, one of which is indicated at 30 in FIG. 1, requires that the circuitry in each of the local indicators 10 include a transmitter, one of which is indicated at 31 in FIG. 1. The remote indicator 30 is preferably positioned at a location to permit the service personnel to conveniently and efficiently determine which customer desires service. The remote indicator 30 thus provides a location accessible to service personnel and enables them to recognize a signal for service.

The remote indicator 30 includes a power source 32, a programmable receiver 33 for sensing waves 34 radiated from the transmitter 31 in local indicator 10, a remote display 35, and a pager transmitter 36.

The receiver 33 in the remote indicator 30 is programmable to sense the radiated signal 34, recognize the identification code of the local indicator 10 signaling for service, and activate the appropriate indicator in the remote display 35. The radiated signal 34 may be coded, using techniques that are similar to those used in conventional garage door openers. Thus, it is not believed necessary to describe the coding technique in detail.

Typical radiated waves 34 include conventional radio and optical signals. In establishments using a plurality of local indicators 10, each local indicator 10 has a unique identification code. When the sensor 13 for one of the local indicators 10 is touched to signal for service, the bistable circuit 15 energizes the transmitter 31 to radiate the wave 34 which Is modulated to include the identification code for the specific local indicator 10 signaling for service.

One or more portable annunciators, collectively indicated at 37 in the remote indicator 30 of FIG. 1, may be selectively activated by the remote indicator 30. The portable annunciators 37, which may resemble pagers, include a suitable indicator to permit service personnel to independently determine which customer desires service without the service personnel having to receive that information from either the local indicator 10 or the remote indicator 30. Thus, in a system equipped with annunciators, the service personnel has three ways to learn that a customer desires service.

Figure 4:
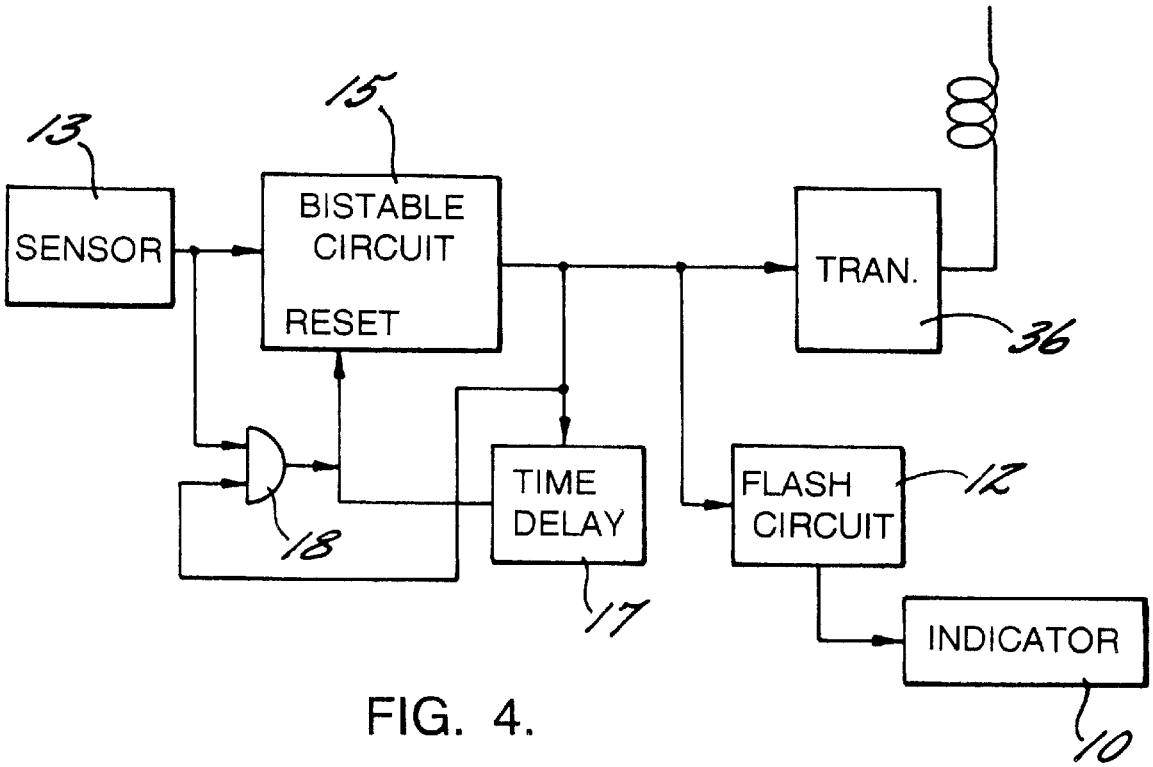
FIG. 4 is a block diagram illustrating the electronic circuitry used in the invention.

Referring to FIG. 4, touching the proximity sensor 13 activates the service. Activation of the bistable circuit 15 energizes the signal light or flashing circuit 12, and optionally activates the transmitter 31 to generate the radiated code signal 34.

Additionally, the output signal of the bistable circuit 15 is coupled to the input terminal of a time delay circuit 17 that generates a pulse after a predetermined time interval. This pulse resets the bistable circuit 15 to its inactive position, which disables the transmitter 31 and turns off the light 12 until the proximity sensor 13 is touched again.

Additionally, the output signal of the bistable circuit 15 is combined in a two input gate circuit 18 with the output signal of the proximity sensor 13 to permit the touching of the proximity sensor 13 to reset the bistable circuit 15. These features assure that the customer activated local indicator will not be left permanently in an energized state. This is especially important when the device is operated from batteries, either rechargeable or replaceable.

A bistable circuit is preferred but the invention is operable with an electric circuit that is not bistable. As used herein, the term bistable circuit means an electric circuit that has an "on" state and an "off" state, and in its "on" state activates the signal light, energizes a transmitter, if provided, to carry out its functions, and returns to the "off" state after a predetermined length of time.

Conclusion

The foregoing embodiments of a customer activated signal for service are merely illustrative of the principles of the invention. The invention can be implemented using commercially available components and conventional construction techniques. Variations and modifications in the above-described invention will be readily apparent to those skilled in the art. Such variations can be made without departing from the spirit and scope of the invention, as expressed in the appended claims.

I claim:

1. A customer activated device for use by a customer to signal service personnel that the customer desires service, said device comprising:

(a) a portable local indicator, including:

(l) a signal light and (ii) a bistable circuit connecting the signal light to a source of power;

(b) an enclosure;

(c) said signal light and said bistable circuit being mounted inside said enclosure; and (d) said binary circuit including a proximity sensor, whereby a customer desiring service activates said device by positioning a portion of the customer's body within a predetermined distance of said proximity sensor to activate said bistable circuit to turn on said signal light to indicate to service personnel that said customer desires service.

2. The invention of claim 1 wherein the enclosure is a simulated beer bottle.

3. The invention of claim 2 wherein the simulated beer bottle has a circular bottom wall that is removable from the rest of the bottle and the power source is a rechargeable battery extending inwardly from the bottom wall of the simulated beer bottle.

4. The invention of claim 3 wherein the rechargeable battery is of less diameter than the removable bottom wall of the simulated beer bottle.

5. The invention of claim 4 which includes a battery charger having sockets shaped to receive the rechargeable battery when the bottom wall of the simulated beer bottle is removed from the bottle and inverted.

* * * * *